US008261569B2

(12) United States Patent
Choi et al.

(10) Patent No.: US 8,261,569 B2
(45) Date of Patent: Sep. 11, 2012

(54) AIR CONDITIONING SYSTEM

(75) Inventors: Song Choi, Seoul (KR); Yun Ho Ryu, Seoul (KR); Beom Soo Seo, Seoul (KR)

(73) Assignee: LG Electronics Inc., Seoul (KR)

( * ) Notice: Subject to any disclaimer, the term of this patent is extended or adjusted under 35 U.S.C. 154(b) by 564 days.

(21) Appl. No.: 12/458,424

(22) Filed: Jul. 10, 2009

(65) Prior Publication Data

US 2010/0050679 A1 Mar. 4, 2010

(30) Foreign Application Priority Data

Aug. 27, 2008 (KR) ..... 10-2008-0083628

(51) Int. Cl.
*F25B 13/00* (2006.01)

(52) U.S. Cl. ..... 62/324.6; 62/498

(58) Field of Classification Search ..... 62/324.6, 62/498, 238.1, 160, 528; 137/487.5, 601.14
See application file for complete search history.

(56) References Cited

U.S. PATENT DOCUMENTS

| | | | | |
|---|---|---|---|---|
| 4,165,037 | A | 8/1979 | McCarson | |
| 4,409,796 | A * | 10/1983 | Fisher | 62/160 |
| 4,493,193 | A * | 1/1985 | Fisher | 62/160 |
| 4,553,401 | A * | 11/1985 | Fisher | 62/160 |
| 5,878,810 | A | 3/1999 | Saito | |
| 6,050,102 | A * | 4/2000 | Jin | 62/324.6 |
| 6,293,123 | B1 * | 9/2001 | Iritani et al. | 62/409 |
| 6,347,528 | B1 * | 2/2002 | Iritani et al. | 62/324.6 |
| 6,615,602 | B2 * | 9/2003 | Wilkinson | 62/238.7 |
| 7,237,405 | B2 * | 7/2007 | Takegami et al. | 62/498 |
| 7,243,505 | B2 * | 7/2007 | Cho et al. | 62/238.7 |
| 7,275,382 | B2 * | 10/2007 | Cho et al. | 62/238.7 |
| 7,481,071 | B2 * | 1/2009 | Choi et al. | 62/238.7 |
| 7,624,590 | B2 * | 12/2009 | Choi et al. | 62/324.1 |
| 7,802,441 | B2 * | 9/2010 | Seefeldt | 62/238.7 |

FOREIGN PATENT DOCUMENTS

| | | |
|---|---|---|
| EP | 1645817 A2 | 4/2006 |
| JP | 1990-166339 | 6/1990 |
| JP | 1994-257901 | 9/1994 |

* cited by examiner

*Primary Examiner* — Mohammad Ali
(74) *Attorney, Agent, or Firm* — McKenna Long & Aldridge LLP

(57) ABSTRACT

An air conditioner includes: a compressor configured to compress refrigerant; an indoor heat exchanger configured to condense the refrigerant compressed by the compressor; an outdoor heat exchanger configured to evaporate the refrigerant condensed by indoor heat exchanger; a heater configured to transfer heat to the refrigerant condensed by the indoor heat exchanger; a first pipe configured to flow fluid towards the heater; a second pipe configured to flow fluid away from the heater; and a bypass pipe configured to flow fluid between the first pipe and the second pipe.

13 Claims, 5 Drawing Sheets

AIR CONDITIONING SYSTEM

This application claims the benefit of Korean Patent Application No. 10-2008-0083628, filed on Aug. 27, 2008, which is hereby incorporated by reference for all purposes as if fully set forth herein.

BACKGROUND OF THE INVENTION

1. Field of the Invention

The present invention relates to an air conditioning system, and more particularly, to an air conditioning system that can be used for both cooling and heating.

2. Discussion of the Related Art

A related art air conditioning system includes a compressor, a four-way valve, an indoor heat exchanger, and an outdoor heat exchanger that are used to perform heat exchange cycles for cooling or heating an indoor area. In heating mode, the outdoor heat exchanger is operated as an evaporator, and the indoor heat exchanger is operated as a condenser. In detail, indoor heating is performed as follows: while refrigerant is evaporated in the outdoor heat exchanger, heat is exchanged between the refrigerant and outdoor air; the refrigerant is then compressed to a high-temperature and high-pressure state by the compressor; and while the compressed refrigerant is condensed at the indoor heat exchanger, heat is exchanged between the refrigerant and indoor air.

A refrigerant heating device can be used to heat the refrigerant evaporated in the outdoor heat exchanger in heating mode. That is, in the case where refrigerant is not smoothly evaporated in the outdoor heat exchanger due to a very low outdoor temperature, the refrigerant is heated before the refrigerant is transferred to the compressor.

SUMMARY

Accordingly, the present invention is directed to an air conditioning system that substantially obviates one or more of the problems due to limitations and disadvantages of the related art.

An advantage of the present invention is to provide an air conditioning system in which refrigerant is not overheated by a refrigerant heating device in heating mode.

Another advantage of the present invention is to provide an air conditioning system can be operated more stably.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an air conditioner, includes: a compressor configured to compress refrigerant; an indoor heat exchanger configured to condense the refrigerant compressed by the compressor; an outdoor heat exchanger configured to evaporate the refrigerant condensed by indoor heat exchanger; a heater configured to transfer heat to the refrigerant condensed by the indoor heat exchanger; a first pipe configured to flow fluid towards the heater; a second pipe configured to flow fluid away from the heater; and a bypass pipe configured to flow fluid between the first pipe and the second pipe.

In another aspect of the present invention, an air conditioner includes: a compressor; an indoor heat exchanger; an outdoor heat exchanger; a heater; a first pipe between the indoor heat exchanger and the outdoor heat exchanger; a second pipe between the first pipe and the heater; a third pipe between the heater and the compressor; and a fourth pipe between the second pipe and the third pipe.

In yet another aspect of the present invention, a refrigerant heating device includes: a heater; a first pipe configured to flow fluid to the heater; a second pipe configured to flow fluid from the heater; and a third pipe configured to bypass fluid between the first and second pipes.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which is illustrated in the accompanying drawings.

Figure 1:
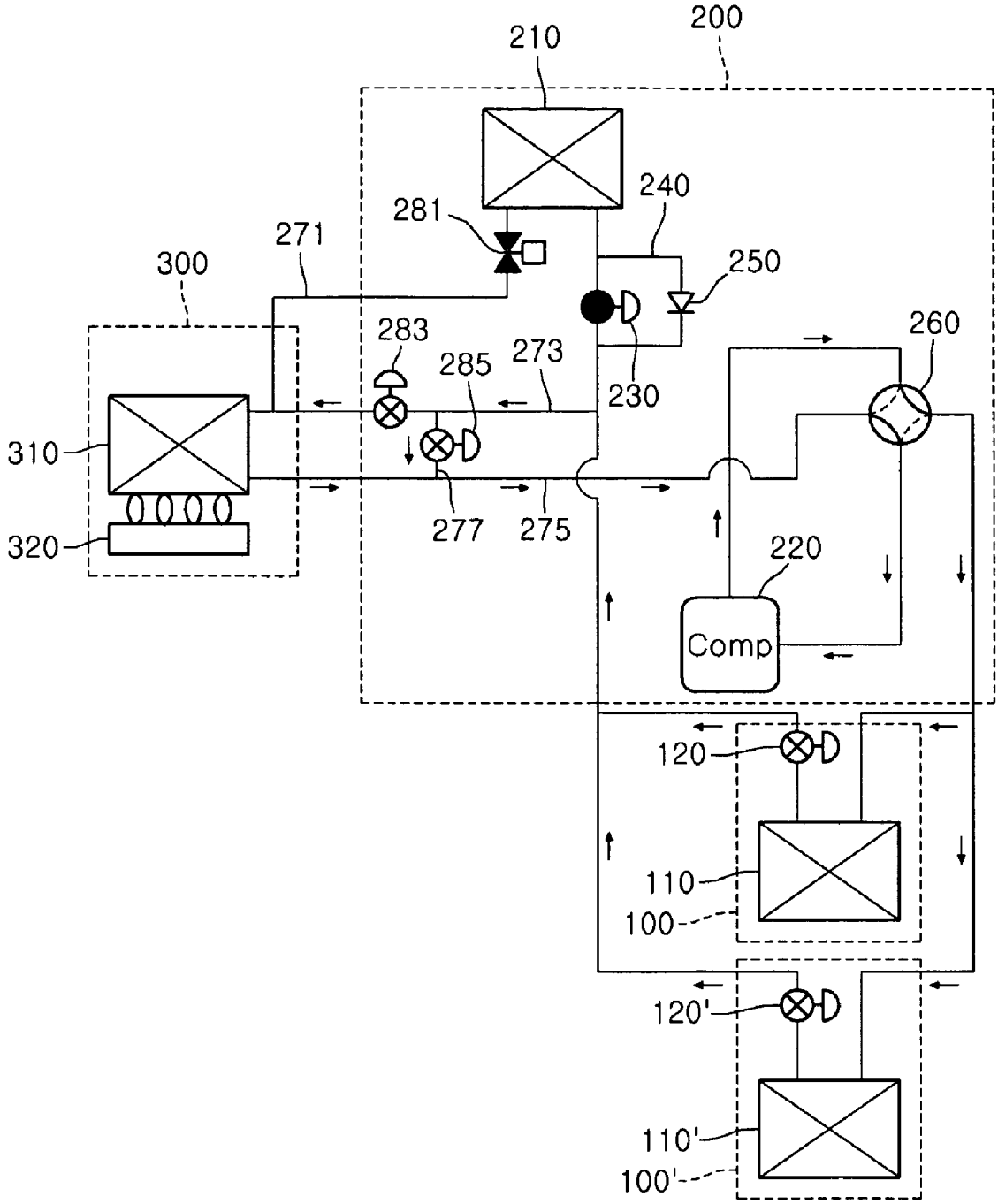
FIGS. 1 and 2 are views for illustrating flows of refrigerant in an air conditioning system when the air conditioning system is operated in heating mode according to a first embodiment.
Figure 2:
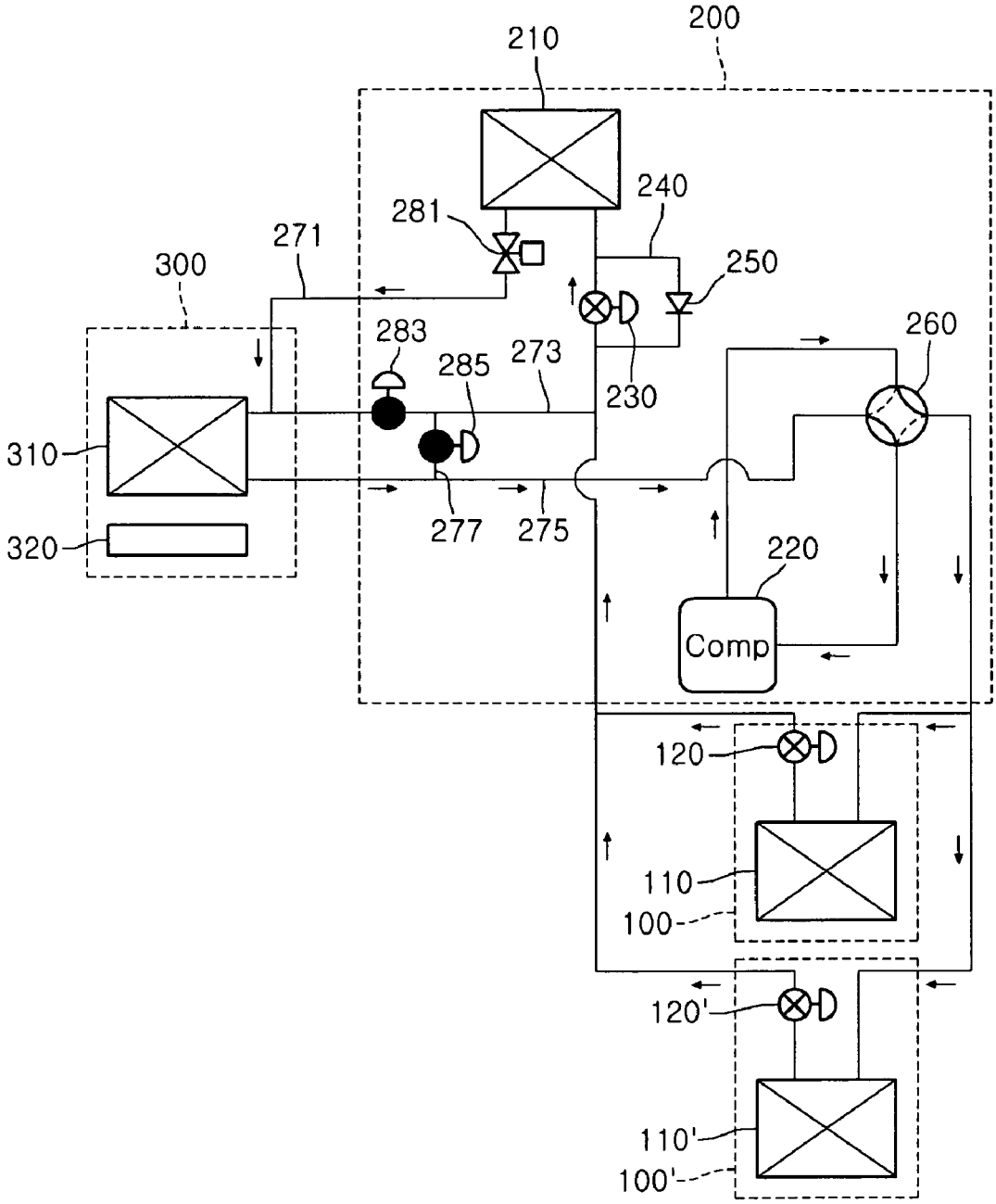
Figure 3:
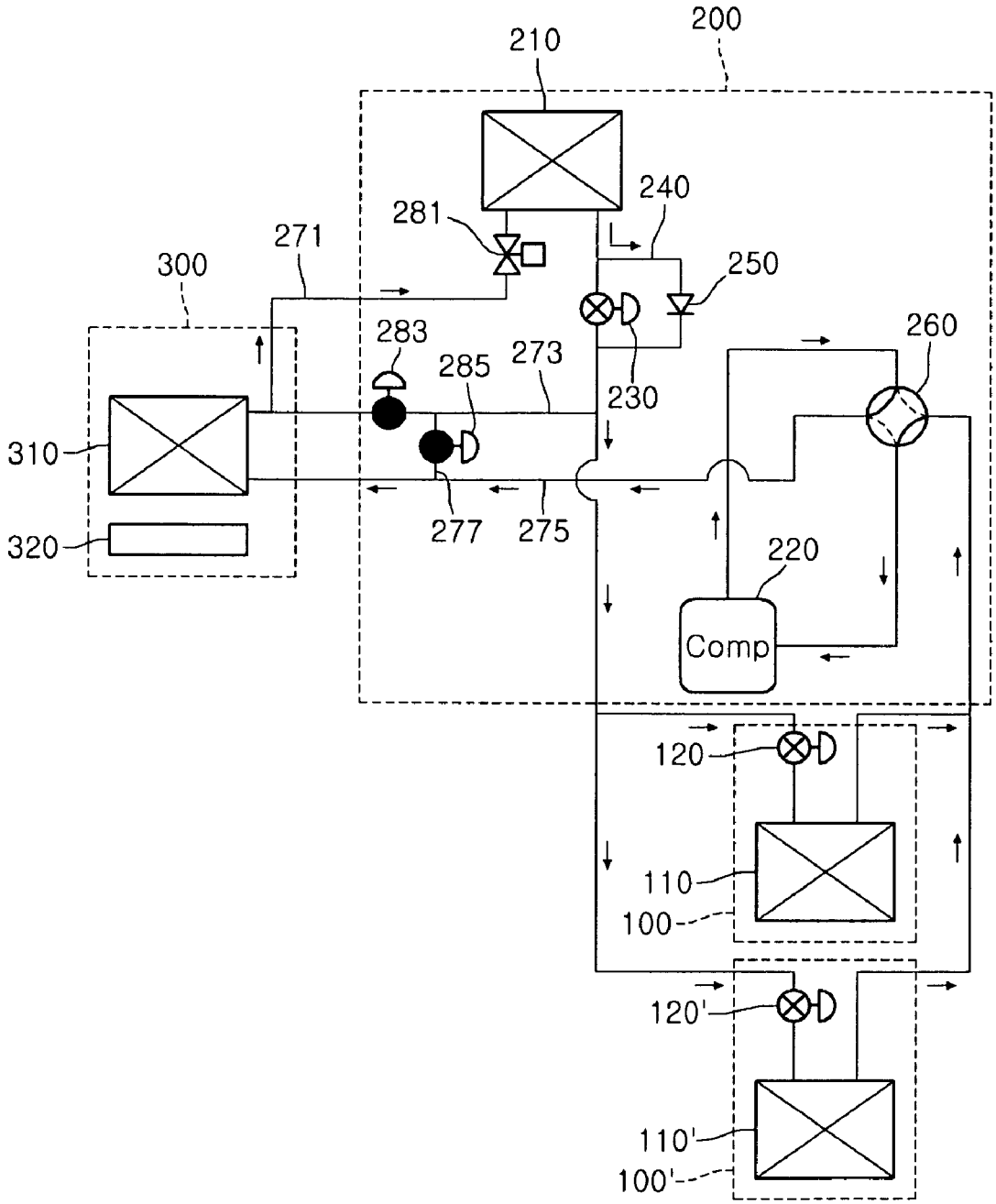
FIG. 3 is a view for illustrating flows of refrigerant in the air conditioning system when the air conditioning system is operated in cooling mode according to the first embodiment.

FIGS. 1 and 2 are views for illustrating flows of refrigerant in an air conditioning system when the air conditioning system is operated in heating mode according to a first embodiment, and FIG. 3 is a view for illustrating flows of refrigerant in the air conditioning system when the air conditioning system is operated in cooling mode according to the first embodiment.

Referring to FIGS. 1 to 3, the air conditioning system is used to cool or heat an indoor area through heat exchange cycles in which refrigerant exchanges heat with indoor air and outdoor air. The air conditioning system includes a plurality of indoor units 100 and 100', and an outdoor unit 200, and a refrigerant heating device 300.

In more detail, the indoor units 100 and 100' include indoor heat exchangers 110 and 110', respectively. The indoor heat exchangers 110 and 110' are operated as condensers in heating mode and evaporators in cooling mode. That is, in heating mode, the indoor heat exchangers 110 and 110' receive refrigerant compressed by a compressor 220 (described later) and condense the refrigerant. In cooling mode, the indoor heat exchangers 110 and 110' receive refrigerant condensed by an outdoor heat exchanger 210 and evaporate the refrigerant.

The indoor units 100 and 100' further include linear expansion valves (LEVs) 120 and 120', respectively. In cooling mode, the linear expansion valves 120 and 120' of the indoor units 100 and 100' are used to expand refrigerant condensed by the outdoor heat exchanger 210. In heating mode, the linear expansion valves 120 and 120' of the indoor units 100 and 100' are opened so that refrigerant can pass through the linear expansion valves 120 and 120'.

The outdoor heat exchanger 210 is included in the outdoor unit 200. The outdoor heat exchanger 210 is operated as an evaporator in heating mode and a condenser in cooling mode. In other words, in heating mode, the outdoor heat exchanger 210 evaporates refrigerant condensed by the indoor heat exchangers 110 and 110' and transfers the evaporated refrigerant to the compressor 220. In cooling mode, the outdoor heat exchanger 210 condenses refrigerant and transfers the condensed refrigerant to the indoor heat exchangers 110 and 110'.

The compressor 220 is included in the outdoor unit 200. The compressor 220 compresses refrigerant and discharges the compressed refrigerant to the indoor heat exchangers 110 and 110' or the outdoor heat exchanger 210. In more detail, the compressor 220 compresses refrigerant and discharges the compressed refrigerant to the indoor heat exchangers 110 and 110' in heating mode and to the outdoor heat exchanger 210 in cooling mode.

The outdoor unit 200 further includes a linear expansion valve 230. In a heating mode not using the refrigerant heating device 300 or in a cooling mode, the linear expansion valve 230 of the outdoor unit 200 expands refrigerant condensed by the indoor heat exchangers 110 and 110' and transfers the refrigerant to the outdoor heat exchanger 210. In a heating mode using the refrigerant heating device 300, the linear expansion valve 230 of the outdoor unit 200 is closed.

The outdoor unit 200 further includes a parallel pipe 240 and a check valve 250. The parallel pipe 240 is connected in parallel to a refrigerant pipe through which refrigerant flows to the outdoor heat exchanger 210 in heating mode. The check valve 250 is disposed at the parallel pipe 240.

The outdoor unit 200 further includes a four-way valve 260. The four-way valve 260 is disposed at refrigerant pipes through which refrigerant compressed by the compressor 220 flows. In heating mode, the four-way valve 260 is positioned in a manner such that refrigerant compressed by the compressor 220 can flow to the indoor heat exchangers 110 and 110' and refrigerant evaporated by the outdoor heat exchanger 210 can flow to the compressor 220. In cooling mode, the four-way valve 260 is positioned in a manner such that refrigerant compressed by the compressor 220 can be discharged to the outdoor heat exchanger 210 and refrigerant condensed by the outdoor heat exchanger 210 can be transferred to the indoor heat exchangers 110 and 110'.

The outdoor unit 200 further includes first to third connection pipes 271, 273, and 275. The first connection pipe 271 connects the outdoor heat exchanger 210 and the refrigerant heating device 300. In heating mode, refrigerant evaporated by the outdoor heat exchanger 210 flows to the refrigerant heating device 300 through the first connection pipe 271. The second connection pipe 273 connects the refrigerant heating device 300 to a refrigerant pipe connected from the indoor heat exchangers 110 and 110' to the outdoor heat exchanger 210. In heating mode, refrigerant condensed by the indoor heat exchangers 110 and 110' flows to the refrigerant heating device 300 through the second connection pipe 273. The third connection pipe 275 connects the compressor 220 and the refrigerant heating device 300. In heating mode, refrigerant heated by the refrigerant heating device 300 flows to the compressor 220 through the third connection pipe 275.

The outdoor unit 200 further includes a bypass pipe 277. In heating mode, the bypass pipe 277 bypasses some of refrigerant condensed by the indoor heat exchangers 110 and 110' and directed to the refrigerant heating device 300. That is, the bypass pipe 277 bypasses some of refrigerant flowing through the second connection pipe 273 to the third connection pipe 275.

The outdoor unit 200 further includes first to third valves 281, 283, and 285. The first valve 281 is disposed at the first connection pipe 271. In heating mode, the first valve 281 is closed if the auxiliary heating device 300 is used to heat refrigerant. The first valve 281 is opened in cooling mode or in heating mode if the auxiliary heating device 300 is not used. The second valve 283 is disposed at the second connection pipe 273. The second valve 283 is opened in heating mode if the auxiliary heating device 300 is used to heat refrigerant. The second valve 283 is closed in cooling mode or in heating mode if the auxiliary heating device 300 is not used. The third valve 285 is disposed at the bypass pipe 277. The third valve 285 is opened in heating mode if the auxiliary heating device 300 is used to heat refrigerant. The third valve 287 is closed in cooling mode or in heating mode if the auxiliary heating device 300 is not used.

Openings of the second and third valves 283 and 285 are adjusted according to the heating load of an indoor area. In more detail, if the second valve 283 is less opened and the third valve 285 is much opened, the amount of refrigerant bypassed through the bypass pipe 277 is increased. On the other hand, if the second valve 283 is much opened and the third valve 285 is less opened, the amount of refrigerant bypassed through the bypass pipe 277 is decreased.

In heating mode, the auxiliary heating device 300 heats refrigerant evaporated by the outdoor heat exchanger 210. For this, the auxiliary heating device 300 includes an auxiliary heat exchanger 310 and a heating unit 320.

In more detail, refrigerant flows from the first connection pipe 271 or the second connection pipe 273 to the inside of the auxiliary heat exchanger 310. The heating unit 320 heats the auxiliary heat exchanger 310 so that refrigerant flowing through the auxiliary heat exchanger 310 can be heated.

An exemplary operation of the air conditioning system will now be described in detail according to the first embodiment.

Referring to FIG. 1, in a heating mode using the auxiliary heating device 300, the linear expansion valve 230 and the first valve 281 of the outdoor unit 200 are closed, and the second and third valves 283 and 285 of the outdoor unit 200 are opened. The heating unit 320 is operated to heat refrigerant flowing through the auxiliary heat exchanger 310. Therefore, during a heat exchange cycle, refrigerant is heated by the auxiliary heating device 300 and then directed to the compressor 220. At this time, the four-way valve 260 is in a heating-mode position.

In more detail, refrigerant compressed by the compressor 220 is discharged to the indoor heat exchangers 110 and 110' through the four-way valve 260. Then, at the indoor heat exchangers 110 and 110', the refrigerant exchanges heat with indoor air and condenses. Therefore, indoor areas can be heated.

Next, the refrigerant condensed at the indoor heat exchangers 110 and 110' passes through the linear expansion valves 120 and 120' of the indoor units 100 and 100' and flows to the auxiliary heat exchanger 310 through the second connection pipe 273. At this time, since the linear expansion valve 230 of the outdoor unit 200 is closed, the refrigerant condensed at the indoor heat exchangers 110 and 110' does not flow to the outdoor heat exchanger 210 directly. In addition, the refrigerant condensed at the indoor heat exchangers 110 and 110' does not flow to the outdoor heat exchanger 210 through the parallel pipe 240 due to the check valve 250.

While the refrigerant flows in the second connection pipe 273 toward the auxiliary heat exchanger 310, the refrigerant expands at the second valve 283. Then, the refrigerant reaches the auxiliary heat exchanger 310 where the refrigerant is heated by the heating unit 320 and is discharged to the third connection pipe 275. Meanwhile, some of the refrigerant flowing in the second connection pipe 273 is bypassed to the third connection pipe 275 through the bypass pipe 277. At this time, while the refrigerant is bypassed to the third connection pipe 275 through the bypass pipe 277, the refrigerant is expanded by the third valve 285. Thereafter, the refrigerant flows from the third connection pipe 275 to the compressor 220, thereby completing one cycle of heat exchange.

Meanwhile, openings of the second and third valves 283 and 285 are adjusted according to the heating load of the indoor areas. That is, if all the refrigerant is heated by the auxiliary heating device 300 during the heat exchange cycle even though the heating load of the indoor areas is low, the refrigerant is in an overheated state when the refrigerant reaches the compressor 220. Therefore, in this case, more refrigerant is bypassed from the second connection pipe 273 to the third connection pipe 275 through the bypass pipe 277. For this, the second valve 283 is less opened, and the third valve 285 is more opened. In other words, by adjusting the openings of the second and third valves 283 and 285, the amount of refrigerant heated by the refrigerant heating device 300 can be adjusted according to the heating load of the indoor areas.

Referring to FIG. 2, in a heating mode not using the refrigerant heating device 300, the linear expansion valve 230 and the first valve 281 of the outdoor unit 200 are opened, and the second and third valves 283 and 285 are closed. The heating unit 320 is not operated such that refrigerant flowing through the auxiliary heat exchanger 310 is not heated. Therefore, refrigerant is not heated by the auxiliary heating device 300 during heat exchange cycles.

In more detail, refrigerant compressed by the compressor 220 is discharged to the indoor heat exchangers 110 and 110' where the refrigerant is condensed. The condensed refrigerant expands while passing through the opened linear expansion valve 230 of the outdoor unit 200 and then reaches the outdoor heat exchanger 210 where the refrigerant evaporates. The evaporated refrigerant flows through the auxiliary heat exchanger 310 and is then sucked by the compressor 220 through the third connection pipe 275. At this time, the heating unit 320 is not operated so that the refrigerant flowing through the auxiliary heat exchanger 310 is not heated. In the case where the auxiliary heat exchanger 310 is installed at an outdoor area, refrigerant flowing through the auxiliary heat exchanger 310 can be evaporated by exchange with outdoor air. As described above, during heat exchange cycles, refrigerant evaporated by the outdoor heat exchanger 210 is transferred to the compressor 220 without being heated by the auxiliary heating device 300.

Referring to FIG. 3, in cooling mode, the opening of the linear expansion valve 230 of the outdoor unit 200 is adjusted, and the first valve 281 is opened but the second and third valves 283 and 285 are closed. The heating unit 320 is not operated such that refrigerant flowing through the auxiliary heat exchanger 310 is not heated. That is, during heat exchange cycles, refrigerant is not heated by the auxiliary heating device 300. The four-way valve 260 is shifted to a cooling-mode position.

In more detail, refrigerant compressed by the compressor 220 is discharged to the outdoor heat exchanger 210. At the outdoor heat exchanger 210, the refrigerant is condensed by heat exchange with outdoor air.

The refrigerant condensed at the outdoor heat exchanger 210 is transferred to the indoor heat exchangers 110 and 110' through the parallel pipe 240. At this time, according to the opened area of the linear expansion valve 230 of the outdoor unit 200, the refrigerant condensed at the outdoor heat exchanger 210 can be transferred to the indoor heat exchangers 110 and 110' through the refrigerant pipe to which the parallel pipe 240 is connected. While the refrigerant is transferred to the indoor heat exchangers 110 and 110', the refrigerant is expanded by the linear expansion valves 120 and 120' of the indoor units 100 and 100'.

At the indoor heat exchangers 110 and 110', the refrigerant is evaporated by heat exchange with indoor air. Therefore, the indoor areas can be cooled by heat exchange between the indoor air and the refrigerant at the indoor heat exchangers 110 and 110'.

After the heat exchange, the refrigerant is transferred from the indoor heat exchangers 110 and 110' to the compressor 220 through the four-way valve 260. The compressor 220 compresses the refrigerant and discharges the compressed refrigerant to the auxiliary heat exchanger 310.

An air conditioning system will now be described in detail with reference to the accompanying drawing according to a second embodiment.

Figure 4:
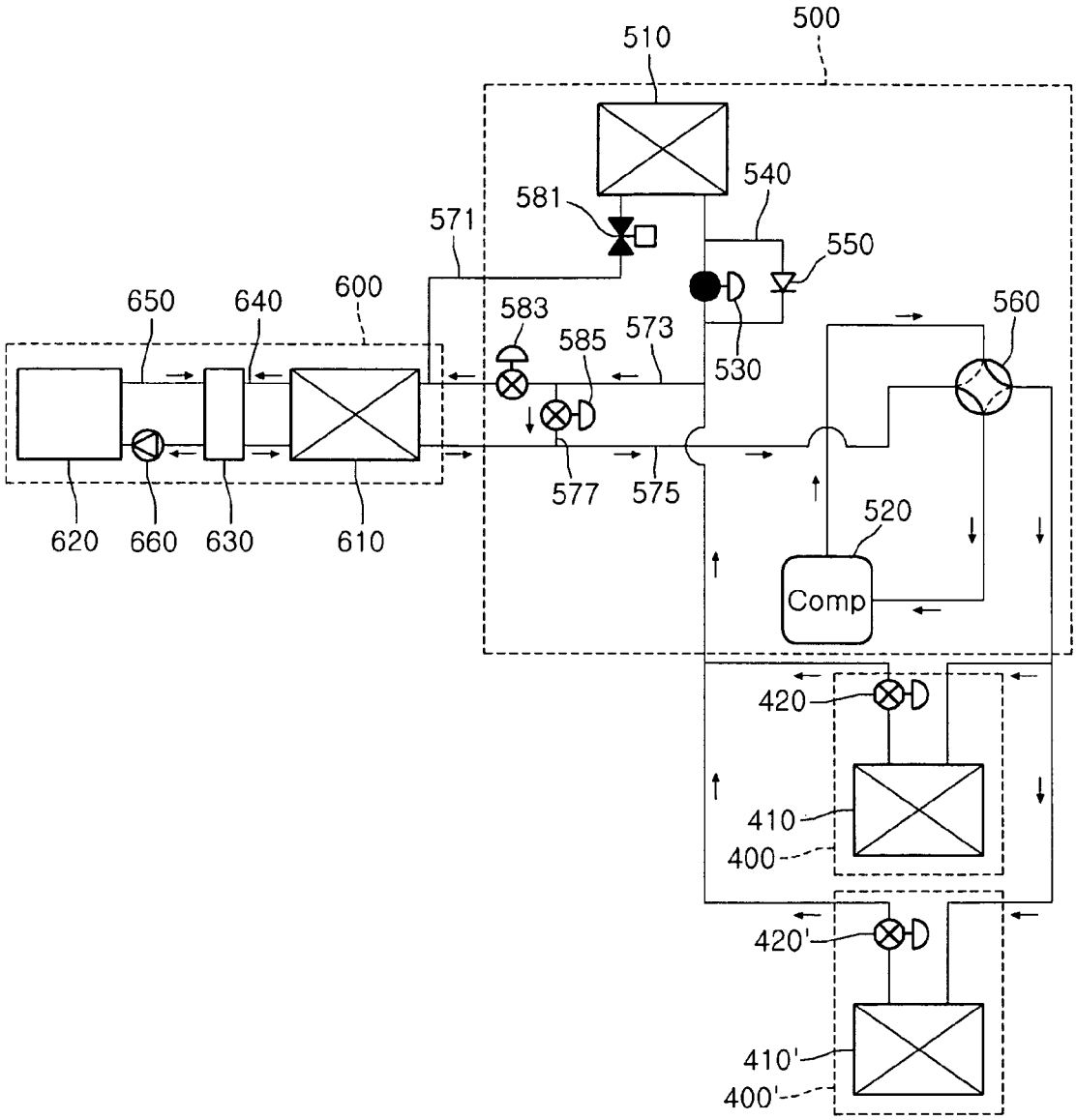
FIG. 4 is view for illustrating flows of refrigerant in an air conditioning system when the air conditioning system is operated in heating mode according to a second embodiment.

FIG. 4 is view for illustrating flows of refrigerant in an air conditioning system when the air conditioning system is operated in heating mode according to a second embodiment. In the current embodiment, the same elements as those in the first embodiment will not be described in detail.

Referring to FIG. 4, in the current embodiment, a auxiliary heating device 600 includes an auxiliary heat exchanger 610, a heating unit 620, a heat exchange unit 630, a heating pipe 640, a fluid pipe 650, and a pump 660. During a heat exchange cycle, refrigerant is transferred to the auxiliary heat exchanger 610. The heating unit 620 heats a working fluid. At the heat exchange unit 630, the refrigerant transferred to the auxiliary heat exchanger 610 exchanges heat with the working fluid heated by the heating unit 620. The refrigerant transferred to the auxiliary heat exchanger 610 flows through the heating pipe 640, and the working fluid heated by the heating unit 620 circulates through the fluid pipe 650. That is, substantially at the heat exchange unit 630, heat exchange occurs between the refrigerant flowing through the heating pipe 640 and the working fluid circulating through the fluid pipe 650. The pump 660 forces the working fluid to circuit through the fluid pipe 650.

In the current embodiment, other elements of the air conditioning system, such as an indoor heat exchanger 410 and a linear expansion valve 420 of an indoor unit 400, an outdoor heat exchanger 510 of an outdoor unit 500, a compressor 520, a linear expansion valve 530, a parallel pipe 540, a check valve 550, a four-way valve 560, first to third connection pipes 571, 573, and 575, a bypass pipe 577, and first to third valves 581, 583, and 585, have the same structures as those of the air conditioning system of the first embodiment. Thus, detailed descriptions thereof will be omitted.

An air conditioning system will now be described in detail with reference to the accompanying drawing according to a third embodiment.

Figure 5:
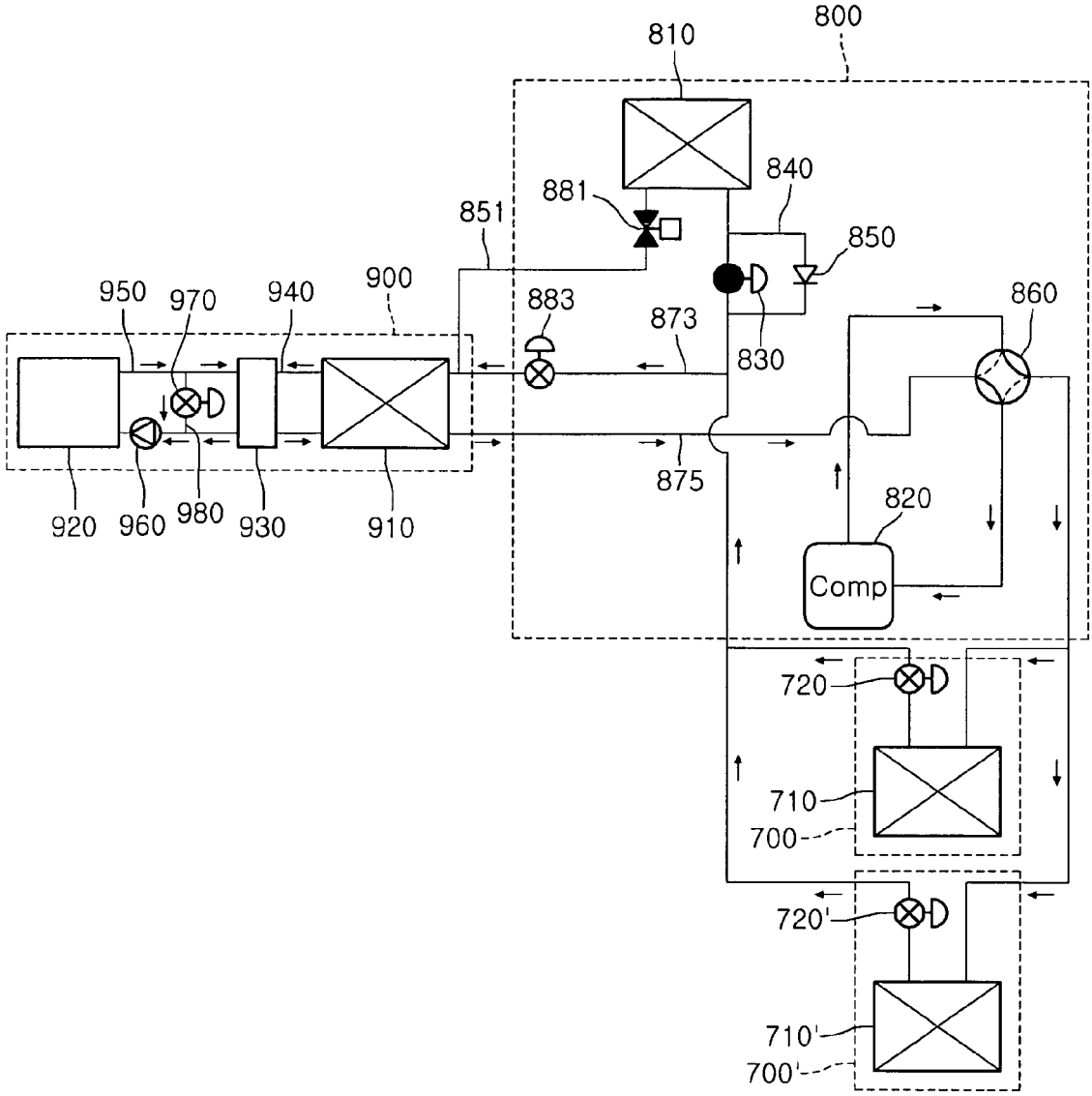
FIG. 5 is a view for illustrating flows of refrigerant in heating mode according to a third embodiment.

FIG. 5 is view for illustrating flows of refrigerant in an air conditioning system when the air conditioning system is operated in heating mode according to a third embodiment. In the current embodiment, the same elements as those in the first embodiment and/or the second embodiment will not be described in detail.

Referring to FIG. 5, in the current embodiment, a refrigerant heating device 900 includes an auxiliary heat exchanger 910, a heating unit 920, a heat exchange unit 930, a heating pipe 940, a fluid pipe 950, and a pump 960. In addition, the auxiliary heating device 900 further includes a bypass pipe 980 and a fourth valve 970. The auxiliary heat exchanger 910, the heating unit 920, the heat exchange unit 930, the heating pipe 940, the fluid pipe 950, and the pump 960 have the same structures as those in the second embodiment.

The pump 960 forces a working fluid to circulate through the fluid pipe 950 so that refrigerant flowing through the heating pipe 940 can exchange heat with the working fluid at the heat exchange unit 930. At this time, some of the working fluid is bypassed to the heating unit 920 through the bypass pipe 980.

The fourth valve 970 is disposed at the bypass pipe 980. The fourth valve 970 is used to adjust heating of the refrigerant flowing through the heating pipe 940 according to the heating load of indoor areas. In more detail, the fourth valve 970 is turned on or off or the opening of the fourth valve 970 is adjusted so as to adjust the amount of working fluid bypassed through the bypass pipe 980. In other words, if the fourth valve 970 is turned off, the working fluid is not bypassed through the bypass pipe 980. If the opened area of the fourth valve 970 is increased or decreased, the amount of working fluid bypassed through the bypass pipe 980 is increased or decreased. Therefore, at the heat exchange unit 930, the amount of working fluid flowing through the fluid pipe 950 for changing heat with the refrigerant flowing through the heating pipe 940 can be adjusted. Accordingly, heating of the refrigerant flowing through the heating pipe 940 can be adjusted. This adjustment of the heating of the refrigerant flowing through the heating pipe 940 may be performed according to the heating load of the indoor areas.

Other elements of the air conditioning system of the current embodiment, such as an indoor heat exchanger 710 and a linear expansion valve 720 of an indoor unit 700, an outdoor heat exchanger 810 of an outdoor unit 800, a compressor 820, a linear expansion valve 830, a parallel pipe 840, a check valve 850, a four-way valve 860, first to third connection pipes 851, 873, and 875, and first and second valves 881 and 883, have the same structures as those of the air conditioning systems of the first and second embodiments. Thus, detailed descriptions thereof will be omitted. However, in the current embodiment, a bypass pipe such as the bypass pipes 277 and 577 of the first and second embodiments, and a third valve such as the third valves 285 and 585 of the first and second embodiments are not used. That is, the bypass pipe 980 and the fourth valve 970 have the same functions as the bypass pipes 277 and 577 and the third valves 285 and 585 of the first and second embodiments.

As described above, according to embodiments of the air conditioning system of the present invention, in heating mode, some of refrigerant is bypassed so as not to heat the bypassed refrigerant using the auxiliary heating device according to the heating load of an indoor area. Therefore, damages or breakage of the compressor can be prevented because refrigerant may not be overheated by the auxiliary heating device before the refrigerant is transferred to the compressor.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An air conditioner, comprising:

a compressor configured to compress refrigerant;

an indoor heat exchanger configured to condense the refrigerant compressed by the compressor;

an outdoor heat exchanger configured to evaporate the refrigerant condensed by indoor heat exchanger;

a heater configured to transfer heat to the refrigerant condensed by the indoor heat exchanger;

a first pipe between the indoor heat exchanger and the outdoor heat exchanger;

a first connection pipe connecting the outdoor heat exchanger to the heater, a second connection pipe configured to selectively flow fluid from the first pipe to the heater; and a third connection pipe configured to flow the fluid from one of the heater and the compressor to the other one, wherein the first connection pipe is configured to selectively flow the fluid from the outdoor heat exchanger to the heater during a heating mode and to flow the fluid from the heater to the outdoor heat exchanger during a cooling mode.

2. The air conditioner of claim 1, wherein the fluid is the refrigerant.

3. The air conditioner of claim 2, wherein the compressor is configured to compress refrigerant evaporated by the outdoor heat exchanger, refrigerant heated by the heater and refrigerant flowed through the bypass pipe.

4. The air conditioner of claim 1, wherein the heater is configured to receive the refrigerant evaporated by the outdoor heat exchanger.

5. The air conditioner of claim 1, further comprising a flow switch valve configured to flow refrigerant from the compressor to the indoor heat exchanger and from the heater to the compressor during a heating mode and to flow refrigerant from the compressor to the outdoor heat exchanger and the heater and from the indoor heat exchanger to the compressor during a cooling mode.

6. The air conditioner of claim 1, further comprising a first expansion valve configured to expand refrigerant flowing to the indoor heat exchanger during the cooling mode.

7. The air conditioner of claim 1, further comprising a second expansion valve configured to expand refrigerant flowing to the outdoor heat exchanger during the heating mode.

8. The air conditioner of claim 1, further comprising a one-way valve in parallel with the second expansion valve that flows refrigerant from the outdoor heat exchanger to the indoor heat exchanger during the cooling mode.

9. The air conditioner of claim 1, further comprising a valve that selectively stops refrigerant flowing to the outdoor heat exchanger during the heating mode.

10. The air conditioner of claim 1, further comprising a bypass pipe configured to flow fluid between the second connection pipe and the third connection pipe.

11. The air conditioner of claim 1, further comprising a first valve between the first connection pipe and the outdoor heat exchanger.

12. The air conditioner of claim 1, further comprising a second valve between the second connection pipe and the heater to selectively flow the fluid.

13. The air conditioner of claim 10, further comprising a third valve on the bypass pipe to selectively flow the fluid.

* * * * *